US011521548B2

(12) United States Patent
Kang et al.

(10) Patent No.: US 11,521,548 B2
(45) Date of Patent: Dec. 6, 2022

(54) DISPLAY DEVICE AND DRIVING METHOD OF THE SAME

(71) Applicant: LG Display Co., Ltd., Seoul (KR)

(72) Inventors: Min-Gu Kang, Seoul (KR); SeungChan Choi, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/408,136

(22) Filed: Aug. 20, 2021

(65) Prior Publication Data

US 2022/0139318 A1 May 5, 2022

(30) Foreign Application Priority Data

Oct. 29, 2020 (KR) ..... 10-2020-0142500

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2300/0819* (2013.01); *G09G 2300/0842* (2013.01)

(58) Field of Classification Search
CPC ..... G09G 3/3233; G09G 2300/0426; G09G 2300/0819; G09G 2300/0842; G09G 3/3266; G09G 3/3275
See application file for complete search history.

(56) References Cited

U.S. PATENT DOCUMENTS

2019/0279564 A1* 9/2019 Kim ..... G09G 3/3233
2021/0125556 A1* 4/2021 Yamamoto ..... G09G 3/3233

* cited by examiner

*Primary Examiner* — Stacy Khoo
(74) *Attorney, Agent, or Firm* — Seed IP Law Group LLP

(57) ABSTRACT

Embodiments of the present disclosure relate to a display device and a driving method of the display device. More particularly, a subpixel includes a first control transistor for controlling a connection between a body of a driving transistor and a first node of the driving transistor, and a second control transistor for controlling a connection between the body of the driving transistor and a second node of the driving transistor, so that it is possible to improve mobility and on-current performance while increasing a S-factor of the driving transistor.

19 Claims, 16 Drawing Sheets

Sampling & Writing (S20)

DISPLAY DEVICE AND DRIVING METHOD OF THE SAME

CROSS REFERENCE TO RELATED APPLICATION

This application claims priority from Korean Patent Application No. 10-2020-0142500, filed on Oct. 29, 2020, which is hereby incorporated by reference for all purposes as if fully set forth herein.

BACKGROUND

Technical Field

The present disclosure relates to a display device and a driving method of a display device.

Description of the Related Art

Transistors are widely used as switching devices or driving devices in the field of electronic devices. In particular, transistors of various functions are used in display panels.

The transistor may be classified, based on the material constituting an active layer, into an amorphous silicon thin film transistor using amorphous silicon as the active layer, a polycrystalline silicon thin film transistor using polycrystalline silicon as the active layer, and an oxide semiconductor thin film transistor using an oxide semiconductor the an active layer.

Device performance of transistors may be expressed by various factors such as mobility, on-current, current driving performance, or sub-threshold swing value (also referred to as S-Factor). Transistors have different functions or uses, and accordingly, transistors are required to be designed to have device performance capable of satisfying the corresponding functions or uses.

BRIEF SUMMARY

The inventors of the present disclosure have realized that, among various device performance factors of transistors, if one device performance factor is improved, another device performance factor may be deteriorated. For example, if the sub-threshold swing value (also referred to as S-Factor) is increased among various device performance factors of transistors, on-current and/or mobility may be reduced. In particular, in the case that the transistor is driving transistors in a subpixel, since the driving transistors can have a great influence on image quality, it is beneficial to provide a solution to the above problem in the related art. The inventors of the present disclosure have provided one or more embodiments that address the above identified technical problem in the related art as well as other problems in the related art.

Embodiments of the present disclosure may provide a display device having subpixel circuit capable of satisfying various device performance factors and a driving method of the display device.

Embodiments of the present disclosure may provide a display device and a driving method thereof capable of increasing an S-Factor of the driving transistor in the subpixel, while increasing the on-current and mobility of the driving transistor to provide improved device performances for the driving transistor.

Embodiments of the present disclosure may provide a display device and a driving method thereof capable of improving gradation expression capability while accurately compensating for deviations in characteristic values of driving transistors in subpixels.

An aspect of the present disclosure may provide a display device including a display panel in which a plurality of subpixels are arranged, wherein each of the plurality of subpixels comprises a light emitting device including a first electrode, a light emitting layer, and a second electrode; a driving transistor for driving the light emitting device and including a first node, a second node, and a third node; a first control transistor for controlling a connection between a body of the driving transistor and a first node of the driving transistor; and a second control transistor for controlling a connection between the body of the driving transistor and a second node of the driving transistor.

When the first control transistor is in a turn-on state, the second control transistor may be in a turn-off state. When the second control transistor is in a turn-on state, the first control transistor may be in a turn-off state.

A driving period before the light emitting device emits light may include a period in which the body of the driving transistor is electrically connected to the first node of the driving transistor. A period during which the light emitting device emits light may include a period in which the body of the driving transistor is electrically connected to the second node of the driving transistor.

In the display device according to embodiments of the present disclosure, each of the plurality of subpixels may further include a first scan transistor for controlling a connection between the first node of the driving transistor and the third node of the driving transistor in response to a first scan signal transmitted from a first scan signal line.

A source node or a drain node of the first control transistor may be electrically connected to the body of the driving transistor. The drain node or the source node of the first control transistor may be electrically connected to the first node of the driving transistor. A gate node of the first control transistor may be electrically connected to the first scan signal line.

In the display device according to embodiments of the present disclosure, each of the plurality of subpixels may further include a first light emission control transistor for controlling a connection between the third node of the driving transistor and a driving voltage line in response to a first light emission control signal transmitted from a first light emission control signal line, and a second scan transistor for controlling a connection between the second node of the driving transistor and a data line in response to a second scan signal transmitted from a second scan signal line.

A source node or a drain node of the second control transistor may be electrically connected to the body of the driving transistor, the drain node or the source node of the second control transistor may be electrically connected to the second node of the driving transistor, and a gate node of the second control transistor may be electrically connected to a third scan signal line different from the first scan signal line and the second scan signal line.

In the display device according to embodiments of the present disclosure, each of the plurality of subpixels may further include a second light emission control transistor for controlling a connection between the first electrode of the light emitting device and the second node of the driving transistor in response to a second light emission control signal transmitted from a second light emission control signal line.

A source node or a drain node of the second control transistor may be electrically connected to the body of the driving transistor, the drain node or the source node of the second control transistor may be electrically connected to the second node of the driving transistor, and a gate node of the second control transistor may be electrically connected to the second light emission control signal line.

In the display device according to embodiments of the present disclosure, each of the plurality of subpixels may further include an initialization transistor for controlling a connection between the first electrode of the light emitting device and an initialization voltage line. A gate node of the initialization transistor may be electrically connected to the first scan signal line.

In the case that the first control transistor is in a turn-on state, the driving transistor may operate as a double gate.

Another aspect of the present disclosure may provide a display device including a display panel in which a plurality of subpixels are arranged, wherein each of the plurality of subpixels may include a light emitting device including a first electrode, a light emitting layer, and a second electrode; and a driving transistor for driving the light emitting device and including a first node, a second node, and a third node. In addition, when the light emitting device does not emit light, a body of the driving transistor may be electrically connected to the first node of the driving transistor, and when the light emitting device emits light, the body of the driving transistor may be electrically connected to the second node of the driving transistor.

In the display device according to embodiments of the present disclosure, each of the plurality of subpixels may further include a first control transistor for controlling a connection between the body of the driving transistor and the first node of the driving transistor, and a second control transistor for controlling a connection between the body of the driving transistor and the second node of the driving transistor In the display device according to embodiments of the present disclosure, each of the plurality of subpixels may further include a first scan transistor for controlling a connection between the first node of the driving transistor and the third node of the driving transistor in response to a first scan signal transmitted from a first scan signal line; a second scan transistor for controlling a connection between the second node of the driving transistor and a data line in response to a second scan signal transmitted from a second scan signal line; and a first light emission control transistor for controlling a connection between the third node of the driving transistor and a driving voltage line in response to a first light emission control signal transmitted from a first light emission control signal line.

A gate node of the first control transistor may be electrically connected to the first scan signal line. A gate node of the second control transistor may be electrically connected to a third scan signal line different from the first scan signal line and the second scan signal line.

In the display device according to embodiments of the present disclosure, each of the plurality of subpixels may further include a first scan transistor for controlling a connection between the first node of the driving transistor and the third node of the driving transistor in response to a first scan signal transmitted from a first scan signal line; a second scan transistor for controlling a connection between the second node of the driving transistor and a data line in response to a second scan signal transmitted from a second scan signal line; a first light emission control transistor for controlling a connection between the third node of the driving transistor and a driving voltage line in response to a first light emission control signal transmitted from a first light emission control signal line; and a second light emission control transistor for controlling a connection between the first electrode of the light emitting device and the second node of the driving transistor in response to a second light emission control signal transmitted from a second light emission control signal line.

A gate node of the first control transistor may be electrically connected to the first scan signal line. A gate node of the second control transistor may be electrically connected to the second light emission control signal line.

Each of the plurality of subpixels may further include an initialization transistor for controlling a connection between the first electrode of the light emitting device and an initialization voltage line.

Another aspect of the present disclosure may provide a driving method of a display device including applying a first voltage to a first node of the driving transistor, applying a second voltage to a second node of the driving transistor, and emitting light from the light emitting device.

During the applying of the first voltage and the applying of the second voltage, there may exist a period in which a body of the driving transistor is electrically connected to the first node of the driving transistor. During the emitting light from the light emitting device, there may exist a period in which the body of the driving transistor is electrically connected to the second node of the driving transistor.

According to embodiments of the present disclosure, there may provide a display device having a subpixel circuit capable of satisfying various device performance factors and a driving method thereof.

According to embodiments of the present disclosure, there may provide a display device and a driving method thereof capable of increasing a S-Factor of the driving transistor in the subpixel, while increasing the on-current and mobility of the driving transistor to provide improved device performances for the driving transistor.

According to embodiments of the present disclosure, there may provide a display device and a driving method thereof capable of improving gradation expression capability while accurately compensating for deviations in characteristic values of driving transistors in subpixels.

DETAILED DESCRIPTION

Figure 1:
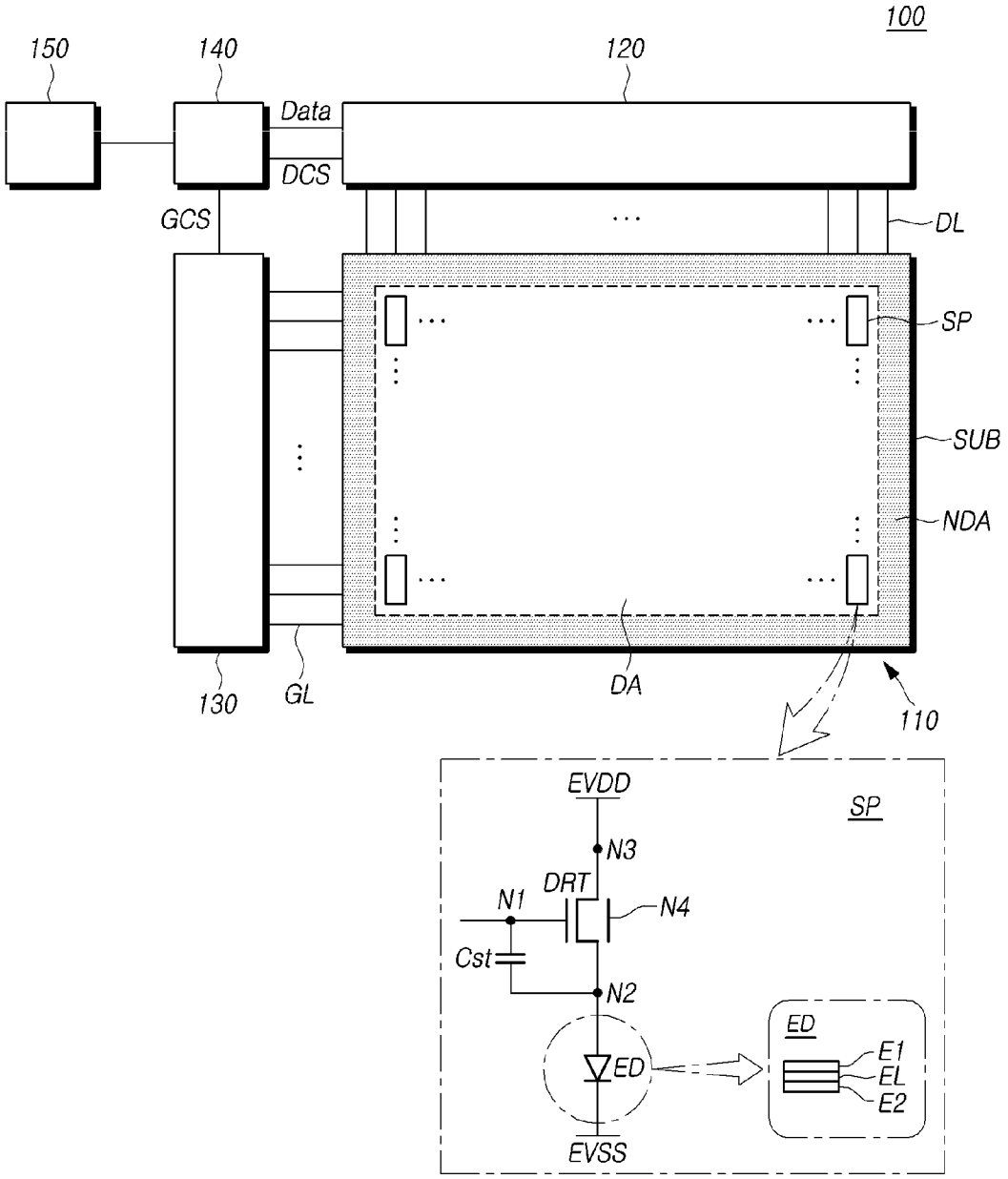
FIG. 1 illustrates a system configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including," "having," "containing," "constituting" "make up of," and "formed of" used herein are generally intended to allow other components to be added unless the terms are used with the term "only." As used herein, singular forms are intended to include plural forms unless the context clearly indicates otherwise.

Terms, such as "first," "second," "A," "B," "(A)," or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to," "contacts or overlaps" etc., a second element, it should be interpreted that, not only can the first element "be directly connected or coupled to" or "directly contact or overlap" the second element, but a third element can also be "interposed" between the first and second elements, or the first and second elements can "be connected or coupled to," "contact or overlap," etc., each other via a fourth element. Here, the second element may be included in at least one of two or more elements that "are connected or coupled to," "contact or overlap," etc., each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes, etc., are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can."

FIG. 1 illustrates a system configuration of a display device 100 according to embodiments of the present disclosure.

Referring to FIG. 1, the display device 100 according to embodiments of the present disclosure may include a display panel 110 and a driving circuit for driving the display panel 110.

The driving circuit may include a data driving circuit 120 and a gate driving circuit 130, and may further include a controller 140 that controls the data driving circuit 120 and the gate driving circuit 130.

The display panel 110 may include a substrate SUB and signal lines such as a plurality of data lines DL and a plurality of gate lines GL disposed on the substrate SUB. The display panel 110 may include a plurality of subpixels SP connected to the plurality of data lines DL and the plurality of gate lines GL.

The display panel 110 may include a display area DA in which an image is displayed and a non-display area NDA that is different from the display area DA without displaying an image. In the display panel 110, the plurality of subpixels SP for displaying an image are disposed in the display area DA. In the non-display area NDA, the driving circuits 120, 130, and 140 may be electrically connected or the driving circuits 120, 130, 140 may be mounted, and there may be disposed a pad portion to which an integrated circuit or a printed circuit is connected.

The data driving circuit 120 is a circuit for driving a plurality of data lines DL, and may supply data signals to the plurality of data lines DL. The gate driving circuit 130 is a circuit for driving a plurality of gate lines GL and may supply gate signals to the plurality of gate lines GL. The controller 140 may supply a data control signal DCS to the data driving circuit 120 in order to control an operation timing of the data driving circuit 120. The controller 140 may supply a gate control signal GCS for controlling an operation timing of the gate driving circuit 130 to the gate driving circuit 130.

The controller 140 may start scanning according to the timing implemented in each frame, and may convert the input image data input from the outside into the converted image data according to the data signal format used by the data driving circuit 120 and supply to the data driving circuit 120, and may control data driving at an appropriate time according to the scan.

The controller 140 may receive, together with the input image data, various timing signals including a vertical synchronization signal VSYNC, a horizontal synchronization signal HSYNC, an input data enable signal DE, a clock signal and the like from the outside (for example, the host system 150).

In order to control the data driving circuit 120 and the gate driving circuit 130, the controller 140 may receive the timing signals such as the vertical synchronization signal VSYNC, the horizontal synchronization signal HSYNC, the input data enable signal DE, the clock signal a vertical synchronization signal (VSYNC), and generate various control signals DCS and GCS output to the data driving circuit 120 and the gate driving circuit 130.

The controller 140 may be implemented as a separate component from the data driving circuit 120, or may be integrated with the data driving circuit 120 to be implemented as an integrated circuit.

The data driving circuit 120 drives a plurality of data lines DL by receiving image data from the controller 140 and supplying data voltages to the plurality of data lines DL. Here, the data driving circuit 120 may be also referred to as a source driving circuit.

The data driving circuit 120 may include one or more source driver integrated circuits SDIC. Each source driver integrated circuit SDIC may include a shift register, a latch circuit, a digital-to-analog converter DAC, an output buffer. Each source driver integrated circuit SDIC may further include an analog-to-digital converter ADC in some cases.

For example, each source driver integrated circuit SDIC may be connected to the display panel 110 by a tape automated bonding (TAB) method, or may be connected to a bonding pad of the display panel 110 by a chip-on-glass (COG) or chip-on-panel (COP) method, or may be implemented in a chip-on-film (COF) method to be connected to the display panel 110.

The gate driving circuit 130 may output a gate signal of a turn-on level voltage or a gate signal of a turn-off level voltage under the control of the controller 140. The gate driving circuit 130 may sequentially drive the plurality of gate lines GL by supplying a gate signal having a turn-on level voltage to the plurality of gate lines GL.

The gate driving circuit 130 may be connected to the display panel 110 by a tape automated bonding (TAB) method, or may be connected to a bonding pad of the display panel 110 by a chip-on-glass (COG) or chip-on-panel (COP) method, or may be implemented in a chip-on-film (COF) method to be connected to the display panel 110. Alternatively, the gate driving circuit 130 may be formed on in the non-display area NDA of the display panel 110 in form of a gate-in-panel (GIP) type. The gate driving circuit 130 may be disposed on or connected to the substrate SUB. That is, in the case of the GIP type, the gate driving circuit 130 may be disposed in the non-display area NDA of the substrate SUB. The gate driving circuit 130 may be connected to the substrate SUB in the case of a chip-on-glass (COG) type, a chip-on-film (COF) type, or the like.

When the specific gate line GL is opened by the gate driving circuit 130, the data driving circuit 120 may convert the image data received from the controller 140 into an analog data voltage, and supply to the data line DL.

The data driving circuit 120 may be connected to one side (e.g., upper or lower side) of the display panel 110. Depending on the driving method or the panel design method, etc., the data driving circuit 120 may be connected to both sides (e.g., upper and lower sides) of the display panel 110, or may be connected to two or more of the four sides of the display panel 110.

The gate driving circuit 130 may be connected to one side (e.g., left or right side) of the display panel 110. Depending on the driving method or the panel design method, etc., the gate driving circuit 130 may be connected to both sides (e.g., left and right sides) of the display panel 110, or to two or more of the four sides of the display panel 110.

The controller 140 may be a timing controller used in a general display technology, or a control device capable of further performing other control functions, including a timing controller, or may be another control device different from the timing controller, or may be a circuit within the control device. The controller 140 may be implemented with various circuits or electronic components such as an integrated circuit (IC), a field programmable gate array (FPGA), an application specific integrated circuit (ASIC), or a processor.

The controller 140 may be mounted on a printed circuit board, a flexible printed circuit, etc., and may be electrically connected to the data driving circuit 120 and the gate driving circuit 130 through a printed circuit board, a flexible printed circuit, or the like.

The controller 140 may transmit and receive signals with the data driving circuit 120 according to one or more predetermined (or selected) interfaces. Here, for example, the interface may include a low voltage differential signaling (LVDS) interface, an EPI interface, and a serial peripheral interface (SPI). The controller 140 may include a storage medium such as one or more registers.

Referring to FIG. 1, each subpixel SP disposed on the display panel 110 of the display device 100 according to the present embodiments may include a light emitting device ED, a driving transistor DRT for driving the light emitting device ED, and a storage capacitor Cst, and the like.

Referring to FIG. 1, the light emitting device ED may include a first electrode E1 and a second electrode E2, and a light emitting layer EL positioned between the first electrode E1 and the second electrode E2.

Referring to FIG. 1, the driving transistor DRT may include a first node N1, a second node N2, and a third node N3, and may further include a fourth node N4. The first node N1 of the driving transistor DRT may be a gate node. The second node N2 of the driving transistor DRT may be a source node or a drain node. The third node N3 of the driving transistor DRT may be a drain node or a source node. The driving voltage EVDD may be applied to the third node N3 of the driving transistor DRT.

Referring to FIG. 1, the driving transistor DRT may be a four-terminal device. The fourth node N4 of the driving transistor DRT may be a body of the driving transistor DRT. Here, the body N4 of the driving transistor DRT may be a light shield (LS) for blocking light.

The driving transistor DRT may be an n-type transistor or a p-type transistor. In the following, it is assumed that the driving transistor DRT is an n-type transistor. For example, the driving transistor DRT may be an oxide transistor in which a semiconductor layer is formed of an oxide semiconductor.

Referring to FIG. 1, the first electrode E1 of the light emitting device ED is a pixel electrode positioned in each of the plurality of subpixels SP, and may be an anode electrode. The first electrode E1 may be electrically connected to the second node N2 of the driving transistor DRT.

Referring to FIG. 1, the second electrode E2 of the light emitting device ED may be a cathode electrode as a common electrode common to a plurality of subpixels SP. A base voltage EVSS may be applied to the second electrode E2.

Referring to FIG. 1, the storage capacitor Cst may be connected between the first node N1 and the second node N2 of the driving transistor DRT. The storage capacitor Cst may charge the amount of charge corresponding to the voltage difference between both ends and maintain the voltage difference between both ends for a predetermined (or selected) frame time. Accordingly, during a predetermined (or selected) frame time, the subpixel SP may emit light.

As described above, the display device 100 according to the present embodiments is a self-luminous display in which each subpixel SP disposed on the display panel 110 emits light by itself through the light emitting device ED. For example, the display device 100 according to the present embodiments may be a self-luminous display such as an organic light emitting diode (OLED) display, a quantum dot display, and a micro light emitting diode (Micro-LED) display.

Meanwhile, in the display device 100 according to the embodiments of the present disclosure, As an index indicating the device performance of the driving transistor DRT of each subpixel SP, there may be used an on-current, mobility, or sub-threshold swing value SS.

Here, the on-current of the driving transistor DRT may mean the current flowing through the driving transistor DRT when a turn-on level voltage is applied to the first node N1 of the driving transistor DRT.

The mobility of the driving transistor DRT is a drift speed of electrons with respect to an applied electric field, and may mean a moving speed of electrons flowing through a channel of the driving transistor DRT.

The sub-threshold swing value SS is also referred to as S-Factor, and has the following definition. As the voltage Vgs between the gate electrode N1 and the source electrode N2 of the driving transistor DRT increases, the drain-source current Ids of the driving transistor DRT increases in a relationship of approximately $Ids \propto (Vgs-Vth)^2$ for a voltage less than or equal to the threshold voltage Vth. In this case, the value of Vgs required to increase Ids 10 times is referred to a sub-threshold swing value SS. The sub-threshold swing value is also referred to as S-Factor. More simply, when the drain current flowing through the driving transistor DRT changes as the gate voltage applied to the gate electrode N1 of the driving transistor DRT changes, the sub-threshold swing value SS may be an reciprocal of the change amount of the drain current (the slope of the Vgs-Ids graph) with respect to the change amount of the gate voltage. As the sub-threshold swing value SS is smaller, the corresponding driving transistor DRT can be operated with a small voltage, and thus, it may be an advantageous device in a power consumption. In the case of the stressed driving transistor DRT, the threshold voltage may increase and the sub-threshold swing value SS may increase. That is, as charges trapped at the interface are generated, the operating characteristics of the driving transistor DRT deteriorate, so that more voltage is required to create an on-state current.

Meanwhile, when the S-factor of the driving transistor DRT is increased, the on-current and mobility of the driving transistor DRT may be reduced. In particular, in the case that the driving transistor DRT is configured as an oxide semiconductor transistor, if the S-factor is increased, on-current and mobility may be reduced.

Meanwhile, the characteristic value of the driving transistor DRT of each subpixel SP of the display device 100 according to the embodiments of the present disclosure may change as the driving time increases. The subpixels SP may have different driving times. As a result, there may occur a characteristic value deviation between the driving transistors DRT, and thus, image quality may be deteriorated.

Accordingly, the display device 100 according to the embodiments of the present disclosure may provide a function of compensating for the characteristic value deviation between the driving transistors DRT by sensing a characteristic value of the driving transistor DRT or a change thereof.

If the S-Factor of the driving transistor DRT is increased, the on-current and mobility as device performance of the driving transistor DRT are lowered. Accordingly, the sensing accuracy of the characteristic value of the driving transistor DRT or a change thereof may be lowered, and a degree of compensating for a characteristic value deviation between the driving transistors DRT may be lowered.

Figure 2:
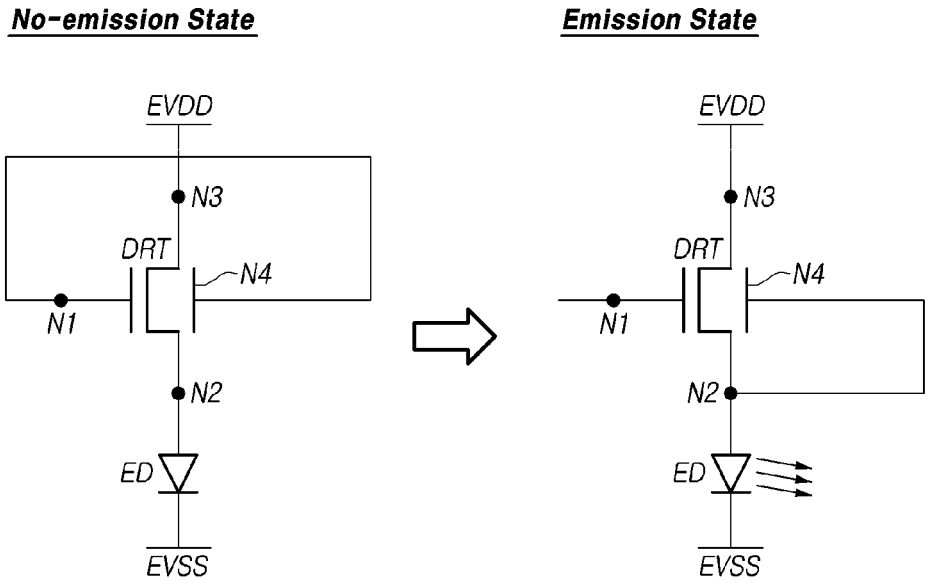
FIG. 2 illustrates two driving states of a subpixel of a display device according to embodiments of the present disclosure.

FIG. 2 illustrates two driving states of a subpixel SP of a display device 100 according to embodiments of the present disclosure.

Referring to FIG. 2, the driving state of the subpixel SP of the display device 100 according to the embodiments of the present disclosure may be in one of a emission states in which the light emitting device ED emits light and a no-emission state in which the light emitting device ED does not emit light.

Referring to FIG. 2, in the display device 100 according to the embodiment of the present disclosure, in order to improve the device performance (e.g., on-current, mobility, etc.) of the driving transistor DRT of each subpixel SP, in the state that the light emitting device ED does not emit light, the body N4 of the driving transistor DRT may be electrically connected to the first node N1 of the driving transistor DRT.

Referring to FIG. 2, in the display device 100 according to the embodiment of the present disclosure, in order to improve the device performance of the driving transistor DRT of each subpixel SP (for example, a sub-threshold swing value SS, etc.), when the light emitting device ED is in the emission state, the body N4 of the driving transistor DRT may be electrically connected to the second node N2 of the driving transistor DRT.

Figure 3:
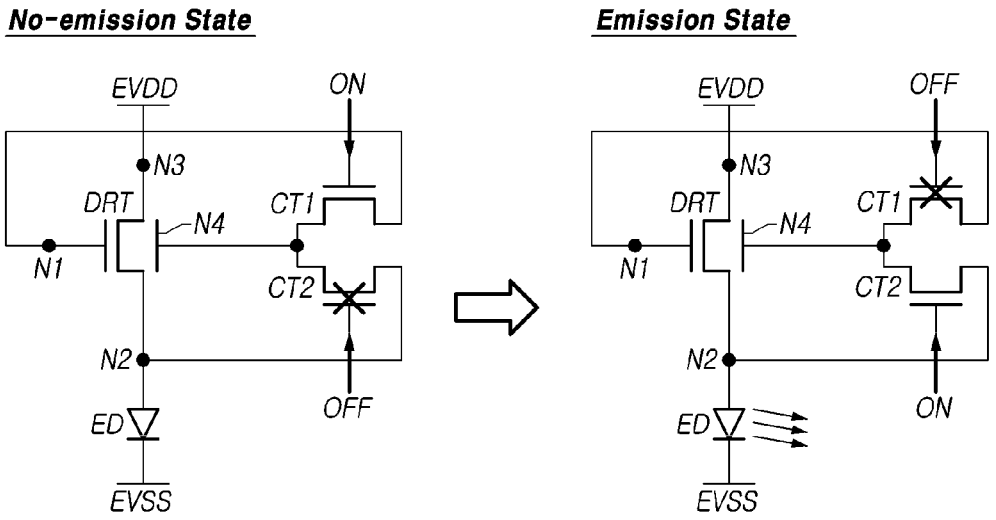
FIG. 3 illustrates two driving states and two control transistors of a subpixel of a display device according to embodiments of the present disclosure.

FIG. 3 illustrates two driving states and two control transistors CT1 and CT2 of a subpixel SP of a display device 100 according to embodiments of the present disclosure.

Referring to FIG. 3, each of a plurality of subpixels SP of the display device 100 according to embodiments of the present disclosure may further include a first control transistor CT1 to control the connection between a body N4 of a driving transistor DRT and a first node N1 of the driving transistor DRT.

Referring to FIG. 3, each of a plurality of subpixels SP of the display device 100 according to embodiments of the present disclosure may further include a second control transistor CT2 to control the connection between the body N4 of the driving transistor DRT and a second node N2 of the driving transistor DRT.

Referring to FIG. 3, in the case that the first control transistor CT1 is turned on when the light emitting device ED is in a no-emission state in which the light emitting device ED does not emit light, the body N4 of the driving transistor DRT and the first node N1 of the driving transistor DRT may be electrically connected. Accordingly, the body N4 of the driving transistor DRT and the first node N1 of the driving transistor DRT may serve as two gate electrodes. Accordingly, since the driving transistor DRT of each subpixel SP operates as a double gate, device performance such as on-current and mobility may be improved.

Referring to FIG. 3, in the case that the light emitting device ED is in the no-emission state, if the first control transistor CT1 is in a turn-on state ON, the second control transistor CT2 is in a turn-off state OFF.

Referring to FIG. 3, in the case that the second control transistor CT2 is turned on when the light emitting device ED emits light, the body N4 of the driving transistor DRT and the second node N2 of the driving transistor DRT may be electrically connected. Accordingly, device performance such as the sub-threshold swing value SS of the driving transistor DRT of each subpixel SP may be improved.

Referring to FIG. 3, in the case that the second control transistor CT2 is in the turn-on state ON when the light emitting device ED is in the emission state, the first control transistor CT1 is in the turn-off state OFF.

Referring to FIG. 3, the first control transistor CT1 and the second control transistor CT2 cannot be in the turn-on state at the same time. At one point in time, if one of the first control transistor CT1 and the second control transistor CT2 is in the turn-on state, the others may be in the turn-off state. That is, if the first control transistor CT1 is in the turn-on state, the second control transistor CT2 may be in the turn-off state. If the second control transistor CT2 is in the turn-on state, the first control transistor CT1 may be in the turn-off state.

Figure 4:
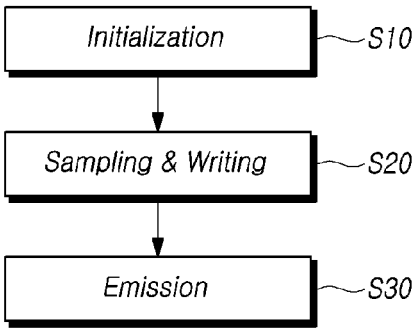
FIG. 4 is a flowchart illustrating a driving of a display device according to an embodiment.

FIG. 4 is a flowchart illustrating a driving of a display device 100 according to embodiments of the present disclosure.

Referring to FIG. 4, a driving method of a display device 100 according to embodiments of the present disclosure may include an initialization step S10 for applying a predetermined (or selected) voltage required for driving the display to at least one of both ends of the storage capacitor Cst, a sampling and writing step S20 in which a characteristic value (e.g., a threshold voltage) of the driving transistor DRT is sensed and compensated, and a light emission step S30 in which the light emitting device ED emits light.

For example, in the initialization step S10, the display device 100 may apply a first voltage (e.g., the driving voltage EVDD) to the first node N1 of the driving transistor DRT. In the sampling and writing operation S20, the display device 100 may apply a second voltage (e.g., the data voltage Vdata) to the second node N2 of the driving transistor DRT. In the light emission step S30, the voltage of the second node N2 of the driving transistor DRT increases, so that a driving current flows through the light emitting device ED such that the light emitting device ED may emit light.

Referring to FIG. 4, while the initialization step S10 and the sampling and writing step S20 are in progress (that is, during the no-emission state of FIGS. 2 and 3), there may exist a period in which the body N4 of the driving transistor DRT is electrically connected to the first node N1 of the driving transistor DRT.

Referring to FIG. 4, while the light emission step S30 is in progress (that is, during the emission state of FIGS. 2 and 3), there may exist a period in which the body N4 of the driving transistor DRT is electrically connected to the second node N2 of the driving transistor DRT.

Hereinafter, it will be described in more detail a structure of the subpixel SP in which the first and second control transistors CT1 and CT2 can be utilized.

Figure 5:
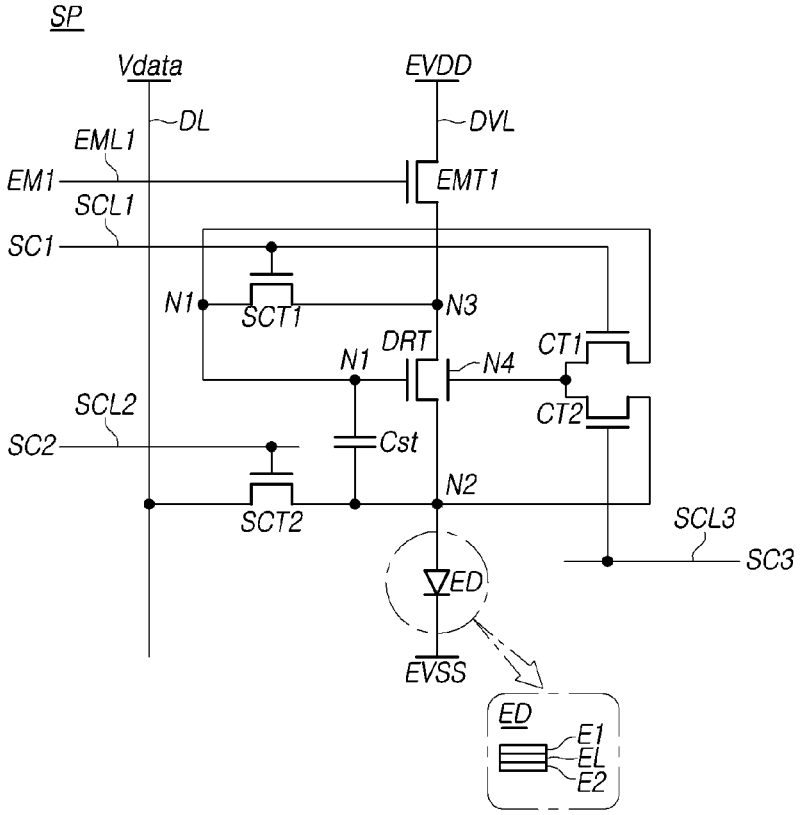
FIG. 5 is an equivalent circuit of subpixels included in a display device according to example disclosure.

FIG. 5 is an equivalent circuit of subpixels SP included in a display device 100 according to example disclosure.

Referring to FIG. 5, each of the plurality of subpixels SP may include a light emitting device ED including a first electrode E1, a light emitting layer EL, and a second electrode E2, a driving transistor DRT that drives the light emitting device ED and includes a first node N1, a second node N2, and a third node N3, a first control transistor CT1 that controls a connection between a body N4 of the driving transistor DRT and the first node N1 of the driving transistor DRT, and a second control transistor CT2 that controls a connection between the body N4 of the driving transistor DRT and the second node N2 of the driving transistor DRT.

The driving transistor DRT may be a four-terminal device. The driving transistor DRT includes a first node N1, a second node N2, and a third node N3, and may further include a fourth node N4. The first node N1 of the driving transistor DRT may be a gate node. The second node N2 of the driving transistor DRT may be a source node or a drain node. The third node N3 of the driving transistor DRT may be a drain node or a source node. The driving voltage EVDD may be applied to the third node N3 of the driving transistor DRT.

The fourth node N4 of the driving transistor DRT may be a body of the driving transistor DRT. Here, the body N4 of the driving transistor DRT may be a light shield LS that blocks light.

The driving transistor DRT may be an n-type transistor or a p-type transistor. In the following, it is assumed that the driving transistor DRT is an n-type transistor.

The first electrode E1 of the light emitting device ED is a pixel electrode positioned in each of the plurality of subpixels SP, and may be an anode electrode. The first electrode E1 may be electrically connected to the second node N2 of the driving transistor DRT.

The second electrode E2 of the light emitting device ED is a common electrode common to the plurality of subpixels SP, and may be a cathode electrode. A base voltage EVSS may be applied to the second electrode E2.

Referring to FIG. 5, each of the plurality of subpixels SP may further include a first scan transistor SCT1 that controls a connection between the first node N1 of the driving transistor DRT and the third node N3 of the driving transistor DRT in response to a first scan signal SC1 transmitted from a first scan signal line SCL1.

Referring to FIG. 5, each of the plurality of subpixels SP is may further include a first light emission control transistor EMT1 for controlling a connection between the node N3 of the driving transistor DRT and a driving voltage line DVL in response to a first light emission control signal EM1 transmitted from a first light emission control signal line EML1.

Referring to FIG. 5, each of the plurality of subpixels SP may further include a second scan transistor SCT2 that controls a connection between the second node N2 of the driving transistor DRT and a data line DL in response to a second scan signal SC2 transmitted from a second scan signal line SCL2.

Referring to FIG. 5, each of the plurality of subpixels SP may further include a storage capacitor Cst connected between the first node N1 and the second node N2 of the driving transistor DRT. The storage capacitor Cst may charge the amount of charge corresponding to the voltage difference between both ends and maintain the voltage difference between both ends for a predetermined (or selected) frame time. Accordingly, during a predetermined (or selected) frame time, the subpixel SP may emit light.

Referring to FIG. 5, when the first control transistor CT1 is in a turn-on state, the second control transistor CT2 may be in a turn-off state. When the second control transistor CT2 is in a turn-on state, the first control transistor CT1 may be in a turn-off state.

Referring to FIG. 5, the driving periods S10 and S20 before the light emitting device ED emits light may include a period in which the body N4 of the driving transistor DRT is electrically connected to the first node N1 of the driving transistor DRT.

Referring to FIG. 5, a light-emission period S30 in which the light emitting device ED emits light may include a period in which the body N4 of the driving transistor DRT is electrically connected to the second node N2 of the driving transistor DRT.

The first control transistor CT1 may have the following connection structure.

A source node or a drain node of the first control transistor CT1 may be electrically connected to the body N4 of the driving transistor DRT.

The drain node or the source node of the first control transistor CT1 may be electrically connected to the first node N1 of the driving transistor DRT.

A gate node of the first control transistor CT1 may be electrically connected to the first scan signal line SCL1. Accordingly, the first control transistor CT1 may be turned on and turned off at the same timing as the first scan transistor SCT1.

In the case that the first control transistor CT1 is in a turn-on state, the body as the fourth node N4 of the driving transistor DRT may be electrically connected to the first node N1 as a gate node of the driving transistor DRT, may have the same potential state as the first node N1 which is the gate node of the driving transistor DRT. Accordingly, if the first control transistor CT1 is in the turn-on state, the driving transistor DRT may operate as a double gate.

The second control transistor CT2 may have the following connection structure.

A source node or a drain node of the second control transistor CT2 may be electrically connected to the body N4 of the driving transistor DRT.

The drain node or the source node of the second control transistor CT2 may be electrically connected to the second node N2 of the driving transistor DRT.

A gate node of the second control transistor CT2 may be electrically connected to a third scan signal line SCL3 different from the first scan signal line SCL1 and the second scan signal line SCL2.

The third scan signal SC3 transmitted from the third scan signal line SCL3 to the gate node of the second control transistor CT2 may be a gate signal having a turn-on level voltage range at different timings from the first scan signal SC1 and the second scan signal SC2.

Figure 6:
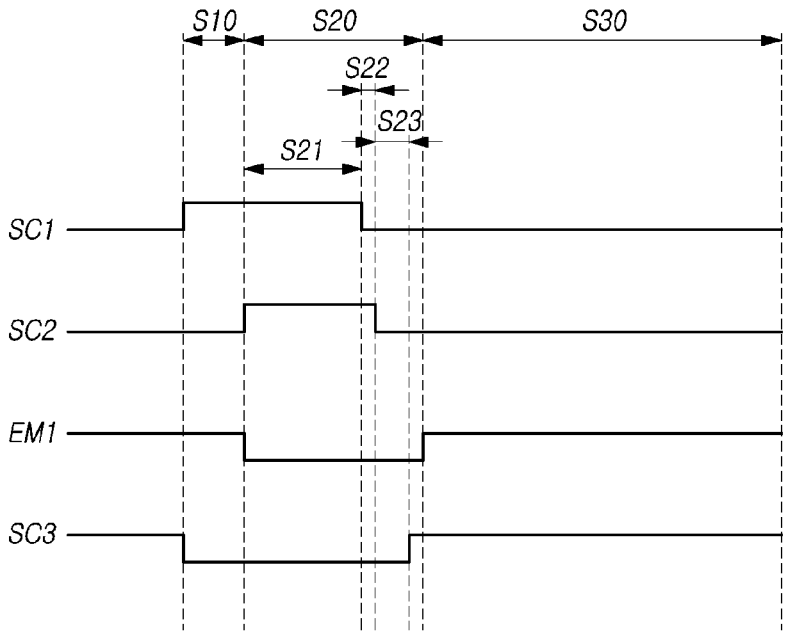
FIG. 6 is a driving timing diagram for the subpixel of FIG. 5.
Figure 7:
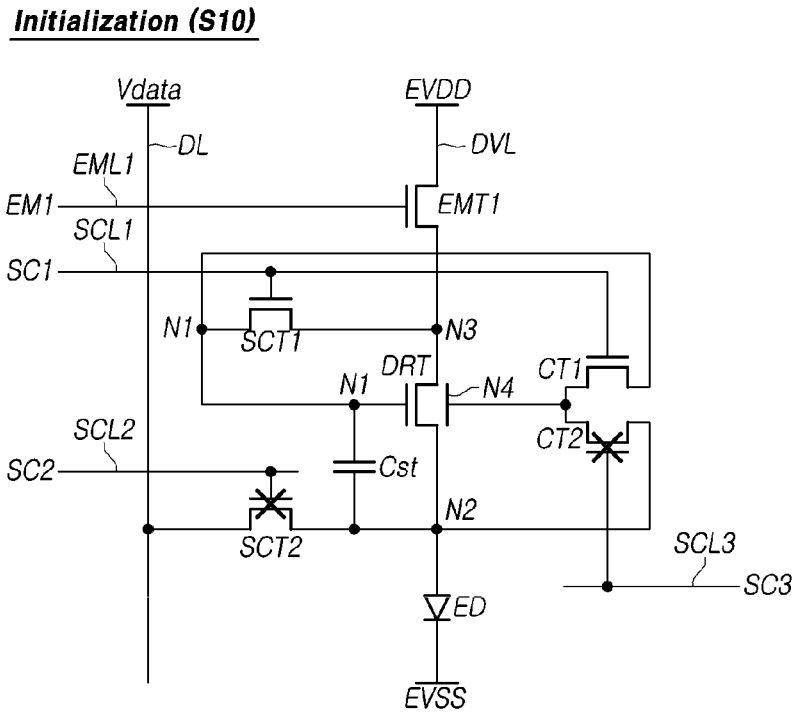
FIG. 7 illustrates a subpixel in an initialization step when the subpixel of FIG. 5 is driven.
Figure 8:
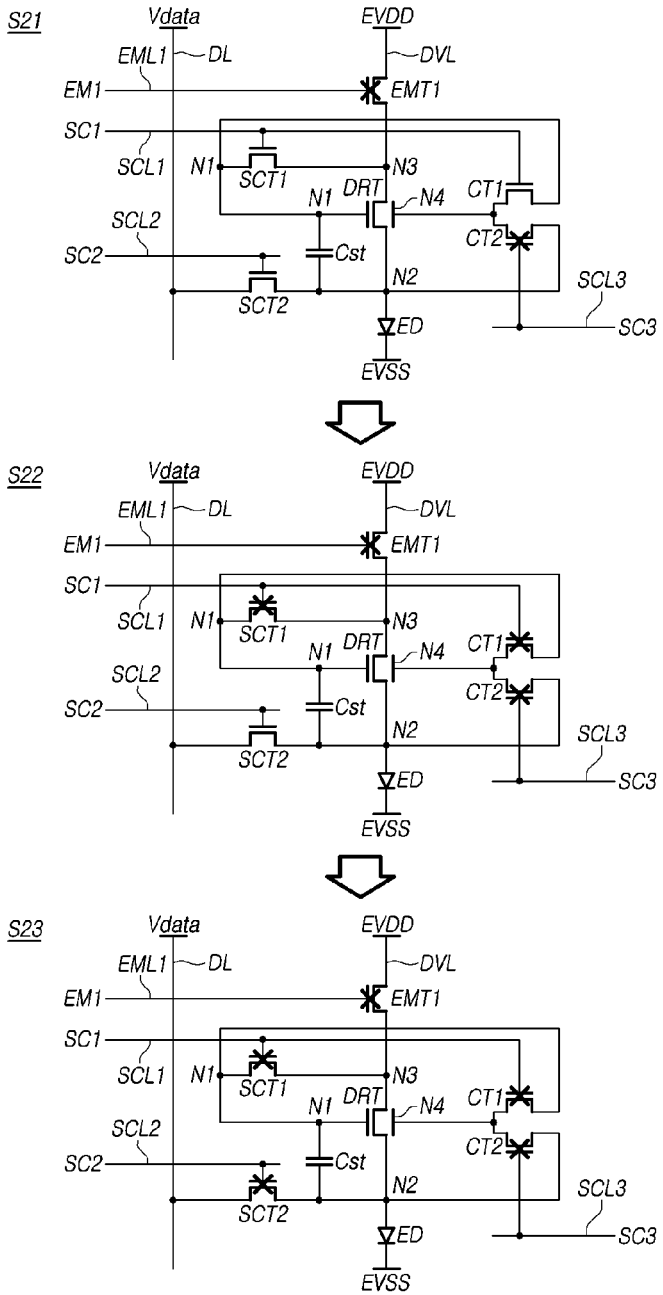
FIG. 8 illustrates a subpixel in a sampling and writing step when the subpixel of FIG. 5 is driven.
Figure 9:
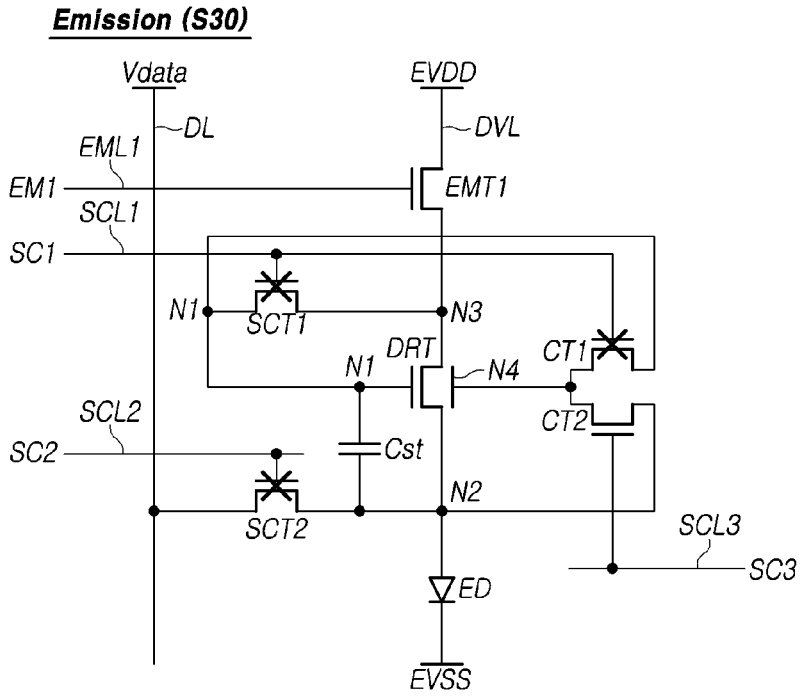
FIG. 9 illustrates a subpixel in a light emission step when the subpixel of FIG. 5 is driven.

FIG. 6 is a driving timing diagram for the subpixel SP of FIG. 5, FIG. 7 illustrates a subpixel SP in an initialization step S10 when the subpixel of FIG. 5 is driven, FIG. 8 illustrates a subpixel SP in a sampling and writing step S20 when the subpixel of FIG. 5 is driven, and FIG. 9 illustrates a subpixel SP in a light emission step S30 when the subpixel of FIG. 5 is driven.

Referring to FIG. 6, a driving period of each of the plurality of subpixels SP may include a first period S10, a second period S20, and a third period S30. Here, the first period S10 is an initialization period, the second period S20 is a sampling and writing period, and the third period S30 is a light emitting period.

Referring to FIG. 6 and FIG. 7, the first period S10 may include a period in which the first scan transistor SCT1, the first control transistor CT1, and the first light emission control transistor EMT1 are in a turn-on state.

Referring to FIG. 6 and FIG. 7, during the first period S10, the second control transistor CT1 and the second scan transistor SCT2 are in a turn-off state.

Referring to FIG. 6 and FIG. 7, during the first period S10, the driving voltage EVDD is applied to the third node N3 through the turned-on first light emission control transistor EMT1. The driving voltage EVDD applied to the third node N3 may be applied to the first node N1 through the turned-on first scan transistor SCT1. That is, during the first period S10, one electrode of the storage capacitor Cst connected to the first node N1 of the driving transistor DRT may be initialized to the driving voltage EVDD.

Referring to FIG. 6 and FIG. 7, during the first period S10, the driving voltage EVDD applied to the first node N1 may be applied to the body N4 of the driving transistor DRT through the turned-on first control transistor CT1.

Referring to FIG. 6 and FIG. 8, the second period S20 may include a period S21 in which the first scan transistor SCT1, the first control transistor CT1, and the second scan transistor SCT2 are in the turn-on state, and a period S22 in which all of the first scan transistor SCT1, the first control transistor CT1, the second control transistor CT2, the second scan transistor SCT2, and the first light emission control transistor EMT1 are in the turn-off state.

In step S21, the first scan transistor SCT1, the first control transistor CT1, and the second scan transistor SCT2 may be in the turn-on state, and the first light emission control transistor EMT1 and the second control transistor CT2 may be in the turn-off state.

In step S21, since the first control transistor CT1 is in the turn-on state, the first node N1 and the fourth node N4 of the driving transistor DRT have the same voltage state. That is, the body, which is the fourth node N4 of the driving transistor DRT, acts as a gate electrode like the first node N1. Accordingly, in step S21, the driving transistor DRT may operate as a double gate. Accordingly, the on-current and mobility of the driving transistor DRT may be increased.

In step S21, the data voltage Vdata output from the data driving circuit 120 to the data line DL may be applied to the second node N2 of the driving transistor DRT through the turned-on second scan transistor SCT2. That is, in step S21, another electrode of the storage capacitor Cst may be written as the data voltage Vdata.

In step S22, the second scan transistor SCT2 may be in a turn-on state, and the first scan transistor SCT1, the first control transistor CT1, the second control transistor CT2, and the first light emission control transistor EMT1 are all may be in a turn-off state.

Accordingly, the second node N2 of the driving transistor DRT may be in a constant voltage state to which the data voltage Vdata is applied, and the first node N1 of the driving transistor DRT may be in a floating voltage state. In this case, the voltage state of the first node N1 of the driving transistor DRT may change according to the threshold voltage of the driving transistor DRT. This may refer to a phenomenon in which the threshold voltage of the driving transistor DRT is internally compensated.

In step S23, all of the first scan transistor SCT1, the first control transistor CT1, the second control transistor CT2, the second scan transistor SCT2, and the first light emission control transistor EMT1 may be in a turn-off state. When step S23 proceeds, the voltage of the second node N2 of the driving transistor DRT may change.

Referring to FIG. 6 and FIG. 9, the third period S30 may include a period in which the first light emission control transistor EMT1 and the second control transistor CT2 are in a turn-on state. During the third period S30, the first light emission control transistor EMT1 and the second control transistor CT2 are in the turn-on state, and the first scan transistor SCT1, the second scan transistor SCT2 and the first control Transistor CT1 are in the turn-off state.

Referring to FIG. 6 and FIG. 9, during the third period S30, since the second control transistor CT2 is in the turn-on state, the body as the fourth node N4 of the driving transistor DRT and a source node as the second node N2 of the driving transistor DRT may be electrically connected. Accordingly, the S-Factor, which is the sub-threshold swing value SS of the driving transistor DRT, may be increased. Accordingly, the gradation expression capability may be improved.

As described above, when the first control transistor CT1 is in the turn-on state (S10 and S20), the second control transistor CT2 is in the turn-off state. When the second control transistor CT2 is in the turn-on state (S30), the first control transistor CT1 is in the turn-off state.

The driving period of the subpixel SP may include, before the light emitting device ED emits light (S10 and S20), a period in which the body N4 of the driving transistor DRT is electrically connected to the first node N1 of the driving transistor DRT.

The driving period of the subpixel SP may include, while the light emitting device ED emits light (S30), a period in which the body N4 of the driving transistor DRT is electrically connected to the second node N2 of the driving transistor DRT.

Referring to FIG. 5 to FIG. 9, when the first scan transistor SCT1 is in the turn-on state or the light emitting device ED does not emit light (S10, S20), the body N4 of the driving transistor DRT may be electrically connected to the first node N1 of the driving transistor DRT.

Referring to FIG. 5 to FIG. 9, when the light emitting device ED emits light (S30), the body N4 of the driving transistor DRT may be electrically connected to the second node N2 of the driving transistor DRT.

Figure 10:
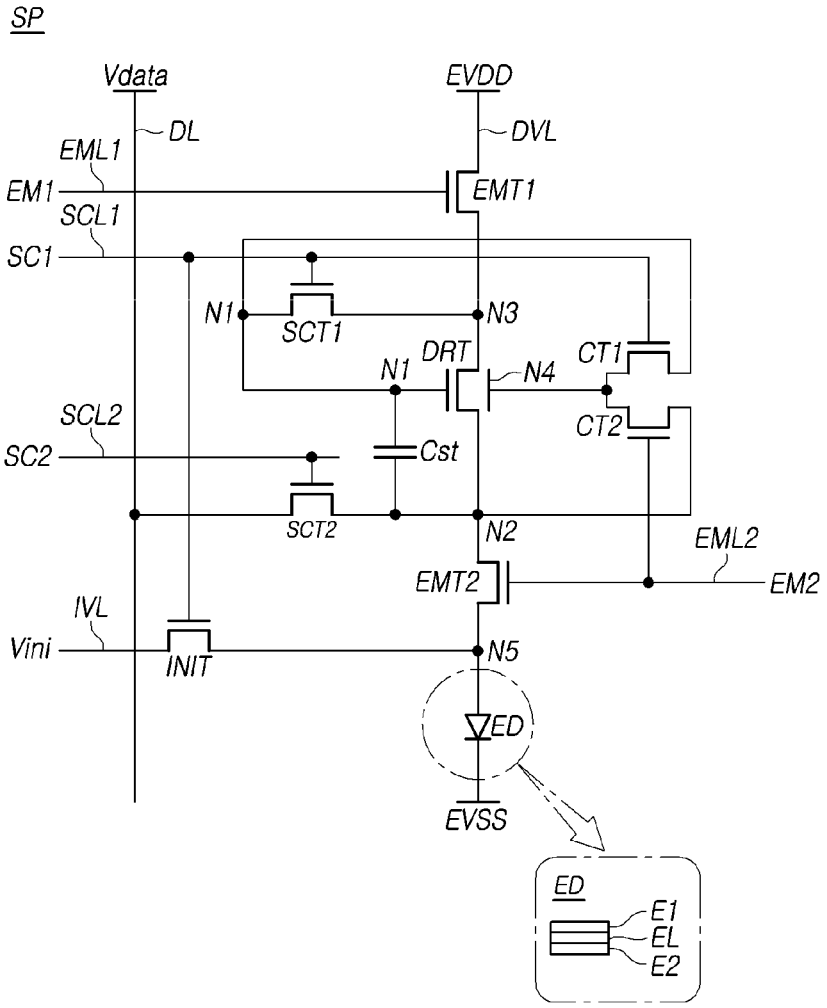
FIG. 10 is an equivalent circuit of subpixels included in a display device according to example embodiments.

FIG. 10 is an equivalent circuit of subpixels SP included in a display device 100 according to example embodiments.

Referring to FIG. 10, each of the plurality of subpixels SP included in the display device 100 according to the embodiments of the present disclosure may include a light emitting device ED including a first electrode E1, a light emitting layer EL, and a second electrode E2; a driving transistor DRT that drives the light emitting device ED and includes a first node N1, a second node N2, and a third node N3; a first scan transistor SCT1 that controls the connection between the first node N1 of the driving transistor DRT and the third node N3 of the driving transistor DRT in response to a first scan signal SC1 transmitted from a first scan signal line SCL1; a second scan transistor SCT2 that controls the connection between the second node N2 of the driving transistor DRT and a data line DL in response to a second scan signal SC2 transmitted from a second scan signal line SCL2; and a first light emission control transistor EMT1 that controls a connection between the third node N3 of the driving transistor DRT and a driving voltage line DVL in response to a first light emission control signal EM1 transmitted from a first light emission control signal line EML1.

Referring to FIG. 10, each of the plurality of subpixels SP included in the display device 100 according to embodiments of the present disclosure may further include a second light emission control transistor EMT2 that controls a connection between the first electrode E1 of the light emitting device ED and the second node N2 of the driving transistor DRT in response to a second light emission control signal EM2 transmitted from a second light emission control signal line EML2. Here, the first electrode E1 of the light emitting device ED may be the fifth node N5 or may be electrically connected to the fifth node N5.

Referring to FIG. 10, each of the plurality of subpixels SP included in the display device 100 according to embodiments of the present disclosure may further include an initialization transistor INIT that controls a connection between the first electrode E1 of the light emitting device ED and an initialization voltage line IVL.

In the subpixel SP shown in FIG. 10, compared to the subpixel SP of FIG. 5, the second light emission control transistor EMT2 and the initialization transistor INIT are further provided. Also, as the second light emission control transistor EMT2 is added, a gate connection structure of the second control transistor CT2 is changed.

Referring to FIG. 10, a source node or a drain node of the second control transistor CT2 may be electrically connected to the body N4 of the driving transistor DRT. The drain node or the source node of the second control transistor CT2 may be electrically connected to the second node N2 of the driving transistor DRT.

Referring to FIG. 10, a gate node of the second control transistor CT2 may be electrically connected to the second light emission control signal line EML2. Accordingly, the second control transistor CT2 may be turned on and off at the same timing as the second light emission control transistor EMT2.

Referring to FIG. 10, the initialization voltage line IVL is a line for transferring an initialization voltage Vini. The initialization voltage Vini transferred from the initialization voltage line IVL may be applied to the fifth node N5 through the turned-on initialization transistor INIT. Here, the fifth node N5 may be the first electrode E1 of the light emitting device ED or may be electrically connected to the first electrode E1 of the light emitting device ED.

Referring to FIG. 10, a gate node of the initialization transistor INIT may be electrically connected to the first scan signal line SCL1. Accordingly, the initialization transistor INIT may be turned on and off at the same timing as the first scan transistor SCT1 and the first control transistor CT1.

Figure 11:
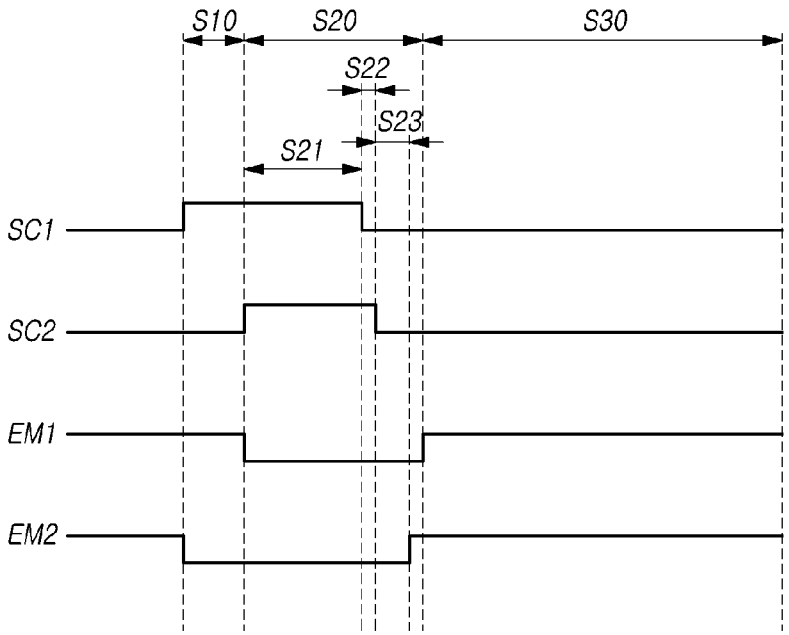
FIG. 11 is a driving timing diagram for the subpixel of FIG. 10.
Figure 12:
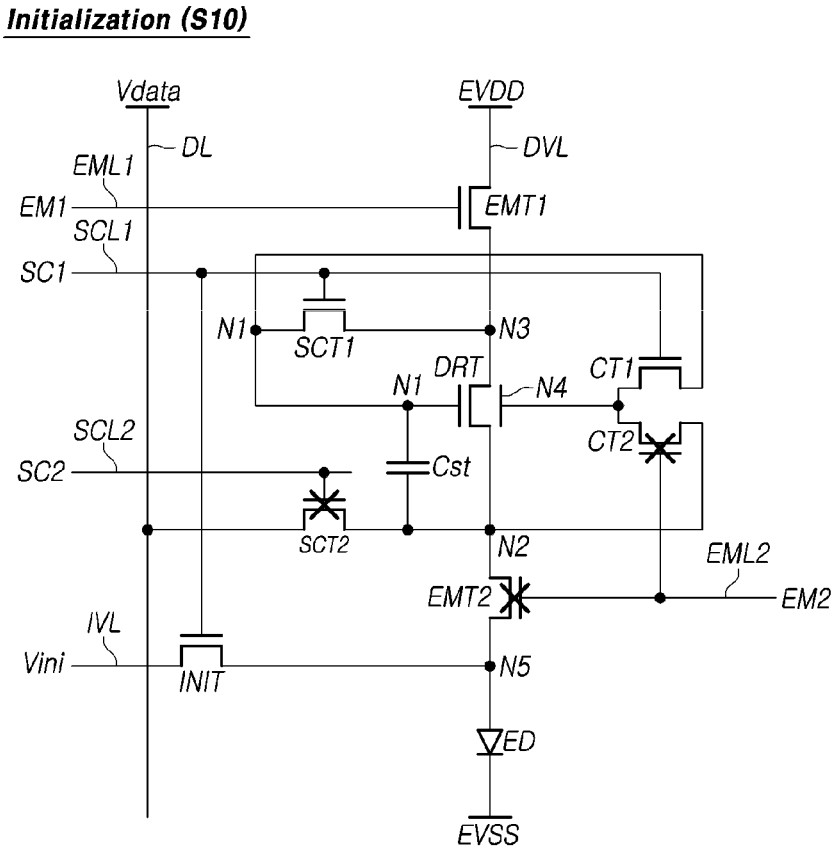
FIG. 12 illustrates a subpixel in an initialization step when the subpixel of FIG. 10 is driven.
Figure 13:
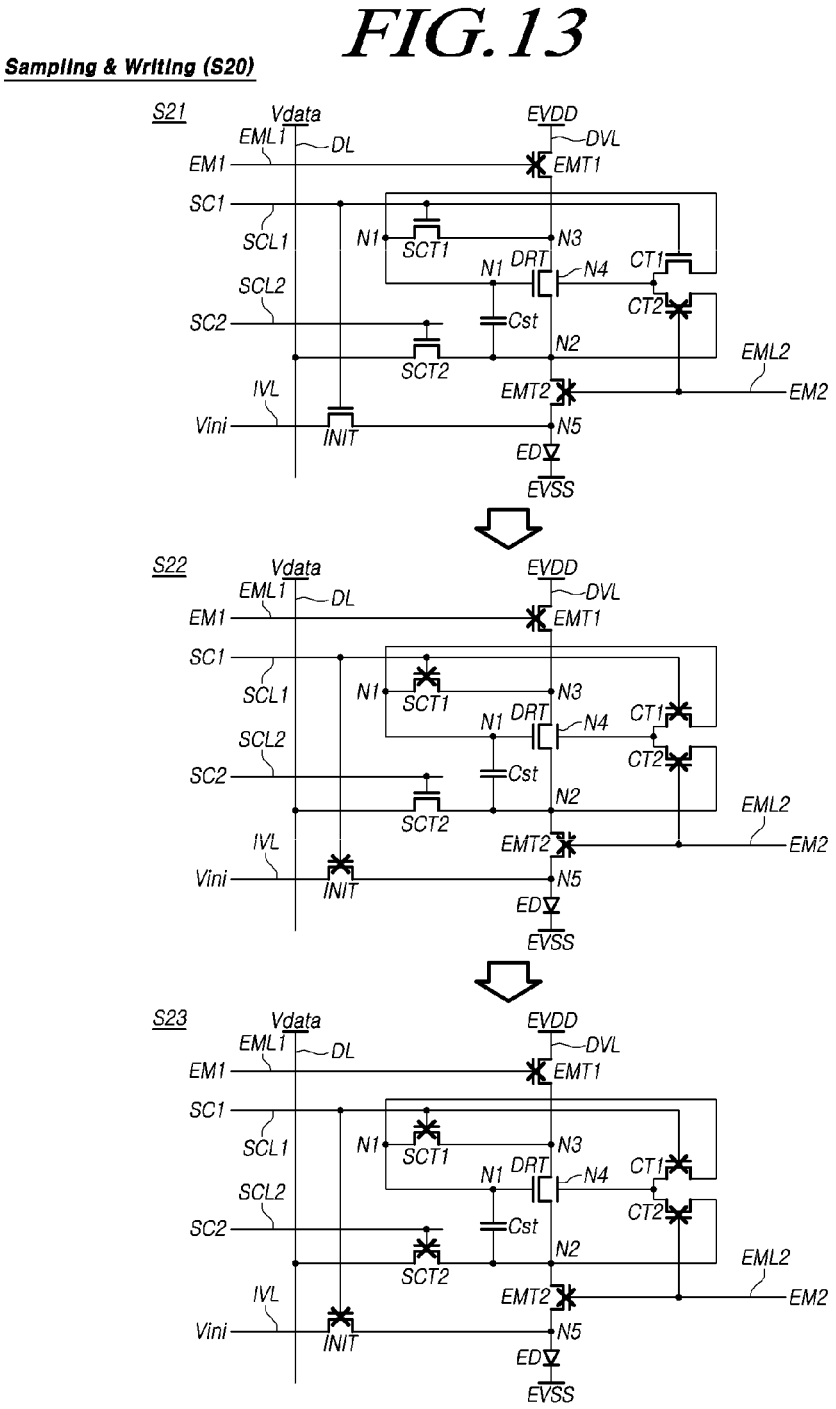
FIG. 13 illustrates a subpixel in a sampling and writing step when the subpixel of FIG. 10 is driven.
Figure 14:
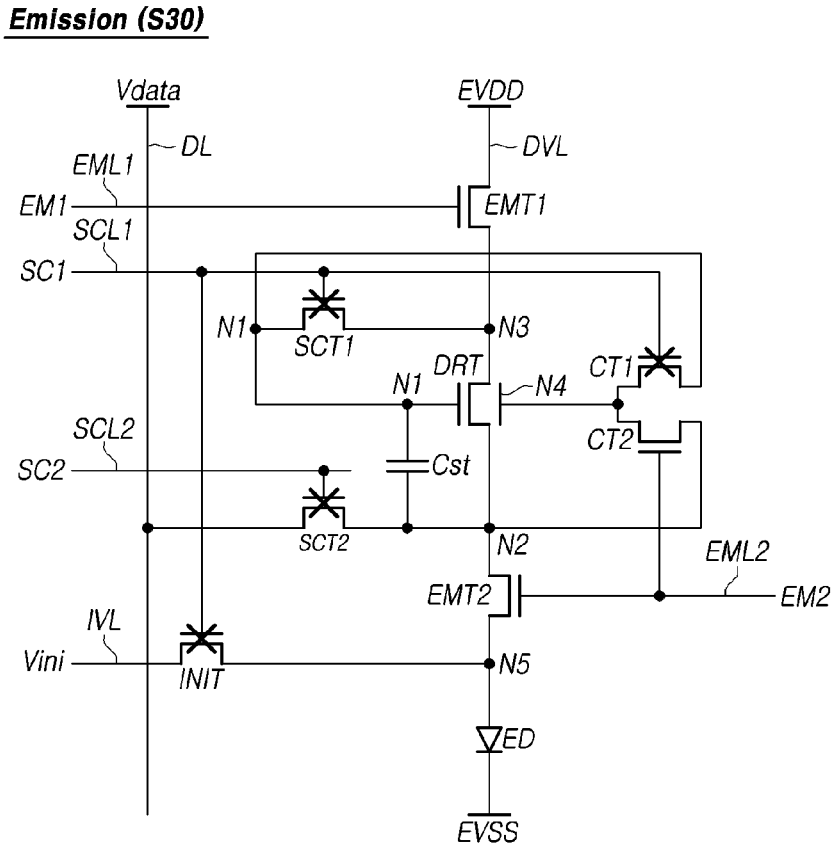
FIG. 14 illustrates a subpixel in a light emission step when the subpixel of FIG. 10 is driven.

FIG. 11 is a driving timing diagram for the subpixel SP of FIG. 10, FIG. 12 illustrates a subpixel SP in an initialization step S10 when the subpixel SP of FIG. 10 is driven, FIG. 13 illustrates a subpixel SP in a sampling and writing step S20 when the subpixel SP of FIG. 10 is driven, and FIG. 14 illustrates a subpixel SP in a light emission step S30 when the subpixel SP of FIG. 10 is driven.

Referring to FIG. 11, a driving period of each of the plurality of subpixels SP may include a first period S10, a second period S20, and a third period S30. Here, the first period S10 is an initialization period, the second period S20 is a sampling and writing period, and the third period S30 is a light emitting period.

Referring to FIG. 11 and FIG. 12, the first period S10 may include a period in which the first scan transistor SCT1, the first control transistor CT1, the first light emission control transistor EMT1, and the initialization transistor INIT are in the turn-on state.

Referring to FIG. 11 and FIG. 12, during the first period S10, the second scan transistor SCT2, the second control transistor CT1, and the second light emission control transistor EMT2 are in a turn-off state.

Referring to FIG. 11 and FIG. 12, during the first period S10, the driving voltage EVDD may be applied to the third node N3 through the turned-on first light emission control transistor EMT1. The driving voltage EVDD applied to the third node N3 may be applied to the first node N1 through the turned-on first scan transistor SCT1. That is, during the first period S10, one electrode of the storage capacitor Cst connected to the first node N1 of the driving transistor DRT may be initialized to the driving voltage EVDD.

Referring to FIG. 11 and FIG. 12, during the first period S10, the driving voltage EVDD applied to the first node N1 may be applied to the body N4 of the driving transistor DRT through the turned-on first control transistor CT1.

Referring to FIG. 11 and FIG. 13, the second period S20 may include a period S21 in which the first scan transistor SCT1, the first control transistor CT1, the second scan transistor SCT2, and the initialization transistor INIT are in a turn-on state; a period S22 in which the first scan transistor SCT1, the first control transistor CT1, the second control transistor CT2, the initialization transistor INIT, the first light emission control transistor EMT1, and the second light emission control transistor EMT2 are in a turn-off state; and a period S23 in which all of the first scan transistor SCT1, first control transistor CT1, second control transistor CT2, second scan transistor SCT2, initialization transistor INIT, the first light emission control transistor EMT1, and the second light emission control transistors EMT2 are in the turn-off state.

In step S21, the first scan transistor SCT1, the first control transistor CT1, the second scan transistor SCT2, and the initialization transistor INIT are in the turn-on state, and the first light emission control transistor EMT1, the second light emission control transistor EMT2 and the second control transistor CT2 may be in the turn-off state.

In step S21, since the first control transistor CT1 is in the turn-on state, the first node N1 and the fourth node N4 of the driving transistor DRT have the same voltage state. That is, the body, which is the fourth node N4 of the driving transistor DRT, acts as a gate electrode like the first node N1. Accordingly, in step S21, the driving transistor DRT may operate as a double gate. Accordingly, the on-current and mobility of the driving transistor DRT may be increased.

In step S21, the data voltage Vdata output from the data driving circuit 120 to the data line DL may be applied to the second node N2 of the driving transistor DRT through the turned-on second scan transistor SCT2. That is, in step S21, another electrode of the storage capacitor Cst may be written as the data voltage Vdata.

In step S22, the second scan transistor SCT2 is in a turn-on state, and all of the first scan transistor SCT1, the first control transistor CT1, the second control transistor CT2, and the initialization transistor INIT, the first light emission control transistor EMT1 and the second light emission control transistor EMT2 may be in a turn-off state. Accordingly, the second node N2 of the driving transistor DRT may have a constant voltage state to which the data voltage Vdata is applied, and the first node N1 of the driving transistor DRT may have a floating voltage state. Accordingly, the voltage state of the first node N1 of the driving transistor DRT changes according to the threshold voltage of the driving transistor DRT. This is a phenomenon in which the threshold voltage of the driving transistor DRT is internally compensated.

In step S23, all of the first scan transistor SCT1, the first control transistor CT1, the second control transistor CT2, the second scan transistor SCT2, the initialization transistor INIT, the first light emission control transistor EMT1 and the second light emission control transistor EMT2 may be in a turn-off state. When step S23 proceeds, the voltage of the second node N2 of the driving transistor DRT may change.

Referring to FIG. 11 and FIG. 14, the third period S30 may include a period in which the first light emission control transistor EMT1, the second light emission control transistor EMT2, and the second control transistor CT2 are in a turn-on state.

During the third period S30, the first light emission control transistor EMT1, the second light emission control transistor EMT2, and the second control transistor CT2 are in the turn-on state, and the first scan transistor SCT1, the second scan transistor SCT2, the first control transistor CT1 and the initialization transistor INIT are in the turn-off state.

Referring to FIG. 11 and FIG. 14, since the second control transistor CT2 is in the turn-on state during the third period S30, the body as the fourth node N4 of the driving transistor DRT and a source node as the second node N2 of the driving transistor DRT may be electrically connected. Accordingly, the S-Factor, which is the sub-threshold swing value SS of the driving transistor DRT, may be increased. Accordingly, the gradation expression capability may be improved.

As described above, when the first control transistor CT1 is in the turn-on state (S10 and S20), the second control transistor CT2 is in the turn-off state. When the second control transistor CT2 is in the turn-on state (S30), the first control transistor CT1 is in the turn-off state.

The driving period of the subpixel SP may include, before the light emitting device ED emits light (S10, S20), a period in which the body N4 of the driving transistor DRT is electrically connected to the first node N1 of the driving transistor DRT.

The driving period of the subpixel SP may include, during the light emitting device ED emits light (S30), a period in which the body N4 of the driving transistor DRT is electrically connected to the second node N2 of the driving transistor DRT.

Referring to FIG. 10 to FIG. 14, when the first scan transistor SCT1 is in the turn-on state or the light emitting device ED does not emit light (S10, S20), the body N4 of the driving transistor DRT may be electrically connected to the first node N1 of the driving transistor DRT.

Referring to FIG. 10 to FIG. 14, when the light emitting device ED emits light (S30), the body N4 of the driving transistor DRT may be electrically connected to the second node N2 of the driving transistor DRT.

Referring to FIG. 10, each of the plurality of subpixels SP may include a light emitting device ED including a first electrode E1, a light emitting layer EL, and a second electrode E2; a driving transistor DRT that drives the light emitting device ED and includes a first node N1, a second node N2, and a third node N3; a first scan transistor SCT1 that controls a connection between the first node N1 of the driving transistor DRT and the third node N3 of the driving transistor DRT in response to a first scan signal SC1 transmitted from a first scan signal line SCL1; a second scan transistor SCT2 the controls a connection between the second node N2 of the driving transistor DRT and a data line DL in response to a second scan signal SC2 transmitted from a second scan signal line SCL2; a first light emission control transistor EMT1 the controls a connection between the third node N3 of the driving transistor DRT and a driving voltage line DVL in response to a first light emission control signal EM1 transmitted from a first light emission control signal line EML1; a second light emission control transistor EMT2 that controls a connection between the first electrode E1 of the light emitting device ED and the second node N2 of the driving transistor DRT in response to a second light emission control signal EM2 transmitted from a second light emission control signal line EML2; and an initialization transistor INIT that controls a connection between the first electrode E1 of the light emitting device ED and a initialization voltage line IVL.

In each of the plurality of subpixels SP, when the first scan transistor SCT1 is in a turn-on state or the light emitting device ED does not emit light, the body N4 of the driving transistor DRT may be electrically connected to the first node N1 of the driving transistor DRT.

In each of the plurality of subpixels SP, when the light emitting device ED emits light, the body N4 of the driving transistor DRT may be electrically connected to the second node N2 of the driving transistor DRT.

Each of the plurality of subpixels SP may further include a first control transistor CT1 that controls a connection between the body N4 of the driving transistor DRT and the first node N1 of the driving transistor DRT, and a second control transistor CT2 the controls a connection between the body N4 of the driving transistor DRT and the second node N2 of the driving transistor DRT.

A gate node of the first control transistor CT1 may be electrically connected to the first scan signal line SCL1. A gate node of the second control transistor CT2 may be electrically connected to the second light emission control signal line EML2.

Figure 15:
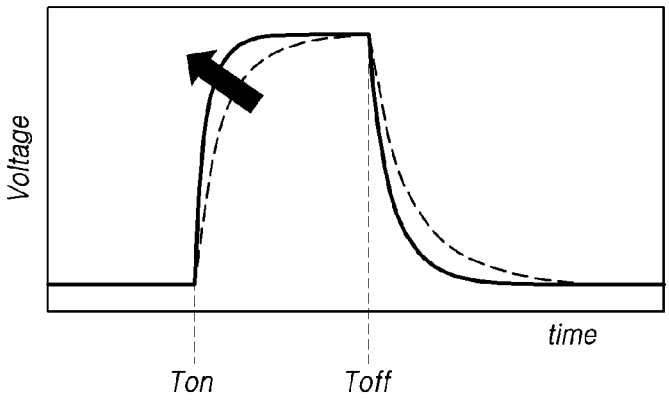
FIG. 15 is a graph for explaining an effect of improving device performance and compensation performance of a driving transistor by a first control transistor in a sampling and writing step of a subpixel of a display device according to example embodiments.

FIG. 15 is a graph for explaining an effect of improving device performance and compensation performance of a driving transistor DRT by a first control transistor CT1 in a sampling and writing step S20 of a subpixel SP of a display device 100 according to example embodiments.

In the sampling and writing step S20 of FIGS. 8 and 13, the first control transistor CT1 is turned on, so that the body as the fourth node N4 of the driving transistor DRT is electrically connected to the first node N1 as a gate node of the driving transistor DRT, thus having the same potential state as that of the first node N1 that is the gate node of the driving transistor DRT. Accordingly, in the sampling and writing step S20 of FIGS. 8 and 13, the first control transistor CT1 is turned on, so that the driving transistor DRT can operate as a double gate.

As described above, if the driving transistor DRT operates as a double gate, the carriers (e.g., electrons) more easily flow through the channel of the driving transistor DRT, and thus the mobility of the driving transistor DRT may increase.

Accordingly, as shown in the graph of FIG. 15, when the gate voltage of the turn-on level voltage is applied at the turn-on timing Ton, the carriers rapidly move through the channel of the driving transistor DRT, so that the driving transistor DRT can be turned on more rapidly. Accordingly, the amount of on-current of the driving transistor DRT may also increase.

Accordingly, in the sampling and writing step S20 of FIGS. 8 and 13, the internal compensation performance of the driving transistor DRT may be greatly improved.

Even when the driving transistor DRT is turned off, it may occur the same phenomenon as when the driving transistor DRT is turned on. As shown in the graph of FIG. 15, when the gate voltage of the turn-off level voltage is applied at the turn-off timing Toff, the driving transistor DRT can be turned off more rapidly by the double gate.

Figure 16:
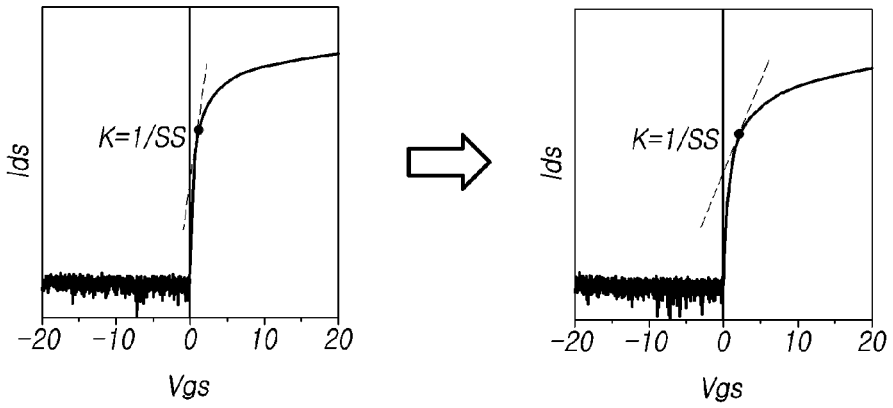
FIG. 16 is a graph for explaining an effect of improving device performance and gradation expression capability of a driving transistor by a second control transistor in a light emission step of a subpixel of a display device according to example embodiments.

FIG. 16 is a graph for explaining an effect of improving device performance and gradation expression capability of a driving transistor DRT by a second control transistor CT2 in a light emission step S30 of a subpixel SP of a display device 100 according to example embodiments.

The left graph of FIG. 16 is a Vgs-Ids graph of the driving transistor DRT of the subpixel SP without the second control transistor CT2, and the graph on the right of FIG. 16 is a Vgs-Ids graph of the driving transistor DRT of the added subpixel SP with the added second control transistor CT2. Here, Vgs is the voltage difference between a gate node N1 and a source node N2 of the driving transistor DRT, and Ids is the drain-source current of the driving transistor DRT.

In the light emission step S30 in FIG. 9 and FIG. 14, when the second control transistor CT2 is turned on, the body as the fourth node N4 of the driving transistor DRT and the source node as the second node N2 of the driving transistor DRT may be electrically connected.

As shown in FIG. 16, in the light emission step S30, if the body as the fourth node N4 of the driving transistor DRT is electrically connected to the source node as the second node N2 of the driving transistor DRT by using the second control transistor CT2, the S-Factor, which is the sub-threshold swing value SS of the driving transistor DRT, may be increased.

Here, the slope K of the Vgs-Ids graph is the reciprocal of the sub-threshold swing value SS (i.e., K=1/SS). Accordingly, in the light emission step S30, if the body as the fourth node N4 of the driving transistor DRT is electrically connected to the source node as the second node N2 of the driving transistor DRT by using the second control transistor CT2, the slope K of the Vgs-Ids graph can be smoothed. Accordingly, the drain-source current Ids between the drain and source may slowly change to some extent according to the gate-source voltage difference Vgs, so that the gradation expression capability may be further improved.

According to embodiments of the present disclosure, it is possible to provide a display device having a subpixel circuit capable of satisfying various device performance factors and a driving method thereof.

According to embodiments of the present disclosure, it is possible to provide a display device and a driving method thereof capable of increasing a S-Factor of the driving transistor in the subpixel, while increasing the on-current and mobility of the driving transistor to provide improved device performances for the driving transistor.

According to embodiments of the present disclosure, it is possible to provide a display device and a driving method thereof capable of improving gradation expression capability while accurately compensating for deviations in characteristic values of driving transistors in subpixels.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure should be construed based on the following claims, and all technical ideas within the scope of equivalents thereof should be construed as being included within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel in which a plurality of subpixels are arranged, wherein each of the plurality of subpixels includes:

a light emitting device including a first electrode, a light emitting layer, and a second electrode;

a driving transistor for driving the light emitting device and including a first node, a second node, and a third node;

a first control transistor for controlling a connection between a body of the driving transistor and the first node of the driving transistor;

a second control transistor for controlling a connection between the body of the driving transistor and the second node of the driving transistor; and a first scan transistor for controlling a connection between the first and third nodes of the driving transistor, wherein the first control transistor and the first scan transistor are turned on or turned off by a same scan signal that is a first scan signal transmitted through a first scan signal line, and that is applied to respective gate nodes of the first control transistor and the first scan transistor.

2. The display device of claim 1, wherein when the first control transistor is in a turn-on state, the second control transistor is in a turn-off state, and when the second control transistor is in a turn-on state, the first control transistor is in a turn-off state.

3. The display device of claim 1, wherein a driving period before the light emitting device emits light includes a period in which the body of the driving transistor is electrically coupled to the first node of the driving transistor, and a period during which the light emitting device emits light includes a period in which the body of the driving transistor is electrically coupled to the second node of the driving transistor.

4. The display device of claim 1, further comprising, wherein either a source node or a drain node of the first control transistor is electrically coupled to the body of the driving transistor, and either the drain node or the source node of the first control transistor is electrically coupled to the first node of the driving transistor.

5. The display device of claim 4, further comprising:

a first light emission control transistor for controlling a connection between the third node of the driving transistor and a driving voltage line in response to a first light emission control signal transmitted from a first light emission control signal line; and a second scan transistor for controlling a connection between the second node of the driving transistor and a data line in response to a second scan signal transmitted from a second scan signal line.

6. The display device of claim 5, wherein either a source node or a drain node of the second control transistor is electrically coupled to the body of the driving transistor, and either the drain node or the source node of the second control transistor is electrically coupled to the second node of the driving transistor, and a gate node of the second control transistor is electrically coupled to a third scan signal line different from the first scan signal line and the second scan signal line.

7. The display device of claim 6, wherein a driving period of each of the plurality of subpixels includes a first period, a second period, and a third period, wherein the first period includes a period in which the first scan transistor, the first control transistor, and the first light emission control transistor are in a turn-on state, wherein the second period includes a period in which the first scan transistor, the first control transistor, and the second scan transistor are in a turn-on state, a period in which the second scan transistor is in a turn-on state, and all of the first scan transistor, the first control transistor, the second control transistor, and the first light emission control transistor are in a turn-off state, and a period in which all of the first scan transistor, the first control transistor, the second control transistor, the second scan transistor, and the first light emission control transistor are in a turn-off state, and wherein the third period includes a period in which the first light emission control transistor and the second control transistor are in a turn-on state.

8. The display device of claim 7, wherein a voltage of the second node of the driving transistor changes during the second period.

9. The display device of claim 5, further comprising a second light emission control transistor for controlling a connection between the first electrode of the light emitting device and the second node of the driving transistor in response to a second light emission control signal transmitted from a second light emission control signal line, wherein either a source node or a drain node of the second control transistor is electrically coupled to the body of the driving transistor, and either the drain node or the source node of the second control transistor is electrically coupled to the second node of the driving transistor, and a gate node of the second control transistor is electrically coupled to the second light emission control signal line.

10. The display device of claim 9, further comprising an initialization transistor for controlling a connection between the first electrode of the light emitting device and an initialization voltage line, wherein a gate node of the initialization transistor is electrically coupled to the first scan signal line.

11. The display device of claim 10, wherein a driving period of each of the plurality of subpixels includes a first period, a second period, and a third period, wherein the first period includes a period in which the first scan transistor, the first control transistor, the first light emission control transistor and the initialization transistor are in a turn-on state, wherein the second period includes a period in which the first scan transistor, the first control transistor, the second scan transistor and the initialization transistor are in a turn-on state, a period in which the second scan transistor is in a turn-on state, and all of the first scan transistor, the first control transistor, the second control transistor, the initialization transistor, the first light emission control transistor and the second light emission control transistor are in a turn-off state, and a period in which all of the first scan transistor, the first control transistor, the second control transistor, the second scan transistor, the initialization transistor, the first light emission control transistor and the second light emission control transistor are in a turn-off state, and wherein the third period includes a period in which the first light emission control transistor, the second light emission control transistor and the second control transistor are in a turn-on state.

12. The display device of claim 11, wherein a voltage difference between the first node and the second node of the driving transistor changes during the second period.

13. The display device of claim 1, wherein when the first control transistor is in a turn-on state, the driving transistor operates as a double gate.

14. A display device comprising:

a display panel in which a plurality of subpixels are arranged, wherein each of the plurality of subpixels includes:

a light emitting device including a first electrode, a light emitting layer, and a second electrode;

a driving transistor for driving the light emitting device and including a first node, a second node, and a third node;

a first control transistor for controlling a connection between a body of the driving transistor and the first node of the driving transistor;

a second control transistor for controlling a connection between the body of the driving transistor and the second node of the driving transistor; and a first scan transistor for controlling a connection between the first and third nodes of the driving transistor, wherein when the light emitting device does not emit light, the body of the driving transistor is electrically connected to the first node of the driving transistor, and when the light emitting device emits light, the body of the driving transistor is electrically connected to the second node of the driving transistor; and wherein the first control transistor and the first scan transistor are turned on or turned off by a same scan signal that is a first scan signal transmitted through a first scan signal line, and that is applied to respective gate nodes of the first control transistor and the first scan transistor.

15. The display device of claim 14, wherein each of the plurality of subpixels further comprises:

a second scan transistor for controlling a connection between the second node of the driving transistor and a data line in response to a second scan signal transmitted from a second scan signal line; and a first light emission control transistor for controlling a connection between the third node of the driving transistor and a driving voltage line in response to a first light emission control signal transmitted from a first light emission control signal line, wherein a gate node of the second control transistor is electrically coupled to a third scan signal line different from the first scan signal line and the second scan signal line.

16. The display device of claim 14, wherein each of the plurality of subpixels further comprises:

a first scan transistor for controlling a connection between the first node of the driving transistor and the third node of the driving transistor in response to a first scan signal transmitted from a first scan signal line;

a second scan transistor for controlling a connection between the second node of the driving transistor and a data line in response to a second scan signal transmitted from a second scan signal line;

a first light emission control transistor for controlling a connection between the third node of the driving transistor and a driving voltage line in response to a first light emission control signal transmitted from a first light emission control signal line; and a second light emission control transistor for controlling a connection between the first electrode of the light emitting device and the second node of the driving transistor in response to a second light emission control signal transmitted from a second light emission control signal line.

17. The display device of claim 16, wherein each of the plurality of subpixels further comprises an initialization transistor for controlling a connection between the first electrode of the light emitting device and an initialization voltage line.

18. The display device of claim 16, wherein a gate node of the first control transistor is electrically coupled to the first scan signal line, and a gate node of the second control transistor is electrically coupled to the second light emission control signal line.

19. A driving method of a display device including a light emitting device and a driving transistor for driving the light emitting device, and a display panel in which a plurality of subpixels are arranged, the driving method comprising:

applying a first voltage to a first node of the driving transistor;

applying a second voltage to a second node of the driving transistor; and emitting light from the light emitting device;

wherein during the applying of the first voltage and the applying of the second voltage, there exists a period in which a body of the driving transistor is electrically coupled to the first node of the driving transistor, and during the emitting light from the light emitting device, there exists a period in which the body of the driving transistor is electrically coupled to the second node of the driving transistor, wherein the display device comprises:

a first control transistor for controlling a connection between the body of the driving transistor and the first node of the driving transistor;

a second control transistor for controlling a connection between the body of the driving transistor and the second node of the driving transistor; and a first scan transistor for controlling a connection between the first and third nodes of the driving transistor, wherein the first control transistor and the first scan transistor are turned on or turned off by a same scan signal that is a scan signal transmitted through a scan signal line, and that is applied to respective gate nodes of the first control transistor and the first scan transistor.

* * * * *